US007463196B2

(12) United States Patent
Hilgers

(10) Patent No.: US 7,463,196 B2
(45) Date of Patent: Dec. 9, 2008

(54) ANTENNA

(75) Inventor: Achim Hilgers, Alsdorf (DE)

(73) Assignee: NXP B.V., Eindhoven (NL)

( * ) Notice: Subject to any disclaimer, the term of this patent is extended or adjusted under 35 U.S.C. 154(b) by 5 days.

(21) Appl. No.: 10/589,838

(22) PCT Filed: Feb. 15, 2005

(86) PCT No.: PCT/IB2005/050577

§ 371 (c)(1),
(2), (4) Date: Apr. 24, 2007

(87) PCT Pub. No.: WO2005/083835

PCT Pub. Date: Sep. 9, 2005

(65) Prior Publication Data

US 2007/0279285 A1 Dec. 6, 2007

(30) Foreign Application Priority Data

Feb. 18, 2004 (EP) ..... 04100635

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 6,433,745 B1 * 8/2002 Nagumo et al. ..... 343/700 MS
6,784,843 B2 * 8/2004 Onaka et al. ..... 343/700 MS

FOREIGN PATENT DOCUMENTS

EP 1 119 069 7/2001
EP 1 289 053 3/2003

* cited by examiner

*Primary Examiner*—Trinh Vo Dinh
*Assistant Examiner*—Dieu Hien T Duong

(57) ABSTRACT

The invention relates to a dual-band antenna for preferable operation in the GSM and DCS frequency range. The dual-band antenna at the same time has the functionality of a diplexer. This makes it possible to produce wireless communication devices with one component less, which in turn reduces weight and production cost.

15 Claims, 2 Drawing Sheets

ANTENNA

CROSS-REFERENCE TO RELATED APPLICATIONS

This application is a National Stage application of PCT Application No. PCT/IB01/50577, filed Feb. 15, 2005.

FIELD OF THE INVENTION

The invention relates to an antenna and an antenna module, respectively, for wireless communication devices, particularly for use in hand-held communication devices such as mobile phones.

BACKGROUND OF THE INVENTION

In mobile telecommunication electromagnetic waves in the microwave region are used to transfer information. An essential part of the telecommunication device is thus the antenna, which enables the reception and the transmission of electromagnetic waves.

Cellular systems of the $2^{nd}$ generation operate in two different frequency bands called GSM (Global System for Mobile) and DCS (Digital Communication System). In Europe the frequency bands GSM 900, which is located at 880 MHz to 960 MHz, and GSM 1800 (DCS), located at 1710 MHz to 1880 MHz, are used. Additionally there is the GSM 850 frequency band from 824 MHz to 894 MHz and the GSM 1900 (PCS) frequency band from 1850 MHz to 1990 MHz mainly used in the United States.

Wireless communication devices operating in two or more frequency bands, for example those which work in the GSM and DCS/PCS frequency bands, need one or more filters to split the signals of a radio frequency front-end into a GSM path and a DCS/PCS path. For this purpose active or passive electronic circuits or complex filter units such as diplexers (or duplexers to separate between the transmitting and the receiving sub-bands) can be used. These filters are connected to the antenna, and serve to switch from one frequency band to another.

In order to satisfy the growing trend towards miniaturization of wireless communication devices efforts have been made to improve and simplify these filters such that they can be made smaller. EP 1 119 069 A2 for example discloses a diplexer of which the flexibility of the frequency shift degree is high and which has a small size.

OBJECT AND SUMMARY OF THE INVENTION

It is an object of the invention to simplify wireless dual-band and multi-band communication devices.

The above object of the invention is achieved by providing the features of the independent claims. By providing the features according to the dependent claims preferred embodiments according to the invention are achieved. It should be emphasized that any reference signs in the claims shall not be construed as limiting the scope of the invention.

According to the present invention the above-mentioned problem is solved by an antenna for wireless communication devices, comprising a dielectric substrate with two pairs of metallic resonator structures provided on its surface, each pair of resonator structures comprising a first resonator structure connected to a feed line, and a second resonator structure having a connection to ground, the first and the second resonator structure being electrically isolated from each other and being arranged adjacent to each other.

The first pair of metallic resonator structures provided on the surface of a substrate has a first resonance frequency corresponding to a first frequency band. Accordingly the second pair of metallic resonator structures has a second resonance frequency in a second frequency band. The antenna thus described allows a dual-band operation. The man skilled in the art will easily derive that this can be generalized to an antenna with resonance frequencies in three, four, five etc. frequency bands which result from three, four, five etc. pairs of resonator structures printed on the surface of the substrate.

The material of the dielectric substrate has a large value of the dielectric constant $\in_r$ ensuring that the maximum antenna extension is particularly small. In this respect a ceramic or a plastic or a compound material is preferred for the substrate, particularly one having a dielectric constant $\in_r$ between 2 and 100, preferably in the region of 4 to 25.

The resonator structures are highly conductive, are possibly metallic, and preferably consist of pure silver. They can also be realized by means of gold or another highly conductive metal or alloy. They do not cross each other and are thus electrically isolated from each other.

Every pair of resonator structures comprises a first resonator structure and a second resonator structure.

The first resonator structure is preferably an elongated structure which is wound around the dielectric substrate, preferably in the form of a strip conductor. One end serves as a feeding point, and is thus connected via a feed line, for example a 50.OMEGA. feed line, to a radio frequency (RF) generator. The second end is left open.

The second resonator structure is also preferably an elongated structure wound around the dielectric substrate, preferably in the form of a strip conductor. One end is connected to ground; the other end is left open. The second resonator structure is electrically isolated from the first resonator structure and arranged adjacent to the first resonator structure.

The proximity of the two resonator structures is responsible for a capacitive coupling between them. The high permittivity of the substrate is responsible for a rather strong coupling. The capacitive coupling stimulates a resonance in the second resonator structure. If the second resonator structure is an elongated structure, its length (and the dielectric constant $\in_r$ of the substrate) determines the value of the resonance frequency. In practise the value is tuned by changing the length of the second resonator structure.

The exact value of the resonance frequency can be tuned by the distance between the first resonator structure and the second resonator structure. A larger distance leads to a weaker coupling shifting the resonance frequency towards lower values. Furthermore it is possible to connect the first and/or second resonator structure to one or more passive components such as resistors, inductive resistors, or capacitors, or combinations of those elements. This again shifts the exact value of the resonance frequency (and/or widens the bandwidth) depending on the component and the way of implementation.

As mentioned above, the antenna has at least two pairs of resonator structures, such that the antenna has at least two resonance frequencies, which enables an operation in at least two frequency bands. From the above paragraph it becomes clear that the two resonance frequencies are in general different from each other.

Experiments resulting in the features according to the invention have shown that the dual-band antenna just described has the additional functionality of a filter. The antenna is able to filter the received signals into the paths corresponding to the different frequency bands of the antenna.

If, for example, the antenna receives electromagnetic waves having frequencies in the first frequency band corresponding to the first resonance frequency of the antenna, the output at the feed line corresponding to the first frequency range is high. On the other hand the output at the feed line corresponding to the second frequency range is low. The situation is just the opposite when the antenna receives electromagnetic waves having frequencies in the second frequency band corresponding to the second resonance frequency of the antenna.

As can be seen the invention relates to a single component which component is an antenna and a (frequency) filter or diplexer at the same time. This simplifies the design of wireless telecommunication devices, as it needs one component less. Furthermore the diplexer antenna allows smaller telecommunication devices being less expensive and having a smaller weight as one component less needs to be mounted. As the antenna can be mounted by conventional surface mounting technologies, and are thus SMD-compatible, the processes to manufacture the telecommunication devices needn't to be changed. The antenna can be aligned either parallel or vertical to the printed circuit board of the telecommunication device.

The antenna used within the scope of this invention is a modified dielectric block antenna (DBA). Further details of this type of antenna, particularly the geometric shape and the material of the resonance structure, the methods to manufacture the resonance structures, and the materials which can be used as a substrate are disclosed in EP 1 289 053 A2, to which this specification explicitly refers to.

In general each second resonance structure has a connection to ground of its own. However, it is possible that at least two such resonance structures share a connection to ground. This possibility can be done by means of an antenna having a single connection to ground, wherein the single connection branches into the second resonator structures. This has the advantage that one port less is needed which simplifies the antenna.

In the simplest case the first and second resonator structures are elongated structures. If the pairs of resonance structures are roughly identical, and if the two or more resonance structures are connected in the same way to passive elements, then the total length of the second resonator structures determines which resonance is stimulated.

Preferably the length of the second resonator structures measured from the point of branching to the open end is different. In this case the length determines the resonance frequency as described above. As an example the lengths can be chosen in such a way that the shorter structure has a resonance in the DCS range, and the longer structure in the GSM range.

If the second resonator structures have different connections to ground, then at least one of the second resonator structures might be connected to one or more passive components. In this way the individual resonance frequency can be tuned and the bandwidth can be widened without affecting the other resonance frequency or the other bandwidth.

As mentioned above the first pair of resonator structures on the substrate has a first resonance frequency. It is preferred that the first resonance frequency is substantially in a frequency range of 824 MHz to 960 MHz, which is the frequency band of GSM 850 and GSM 900.

The second pair of resonator structures on the substrate has a second resonance frequency. It is preferred that the second resonance frequency is substantially in a frequency range of 1710 MHz to 1990 MHz, which is the frequency band of PCS/PCS. These and other aspects of the invention will be apparent from and elucidated with reference to the embodiments described thereafter.

DESCRIPTION OF EMBODIMENTS

Figure 1:
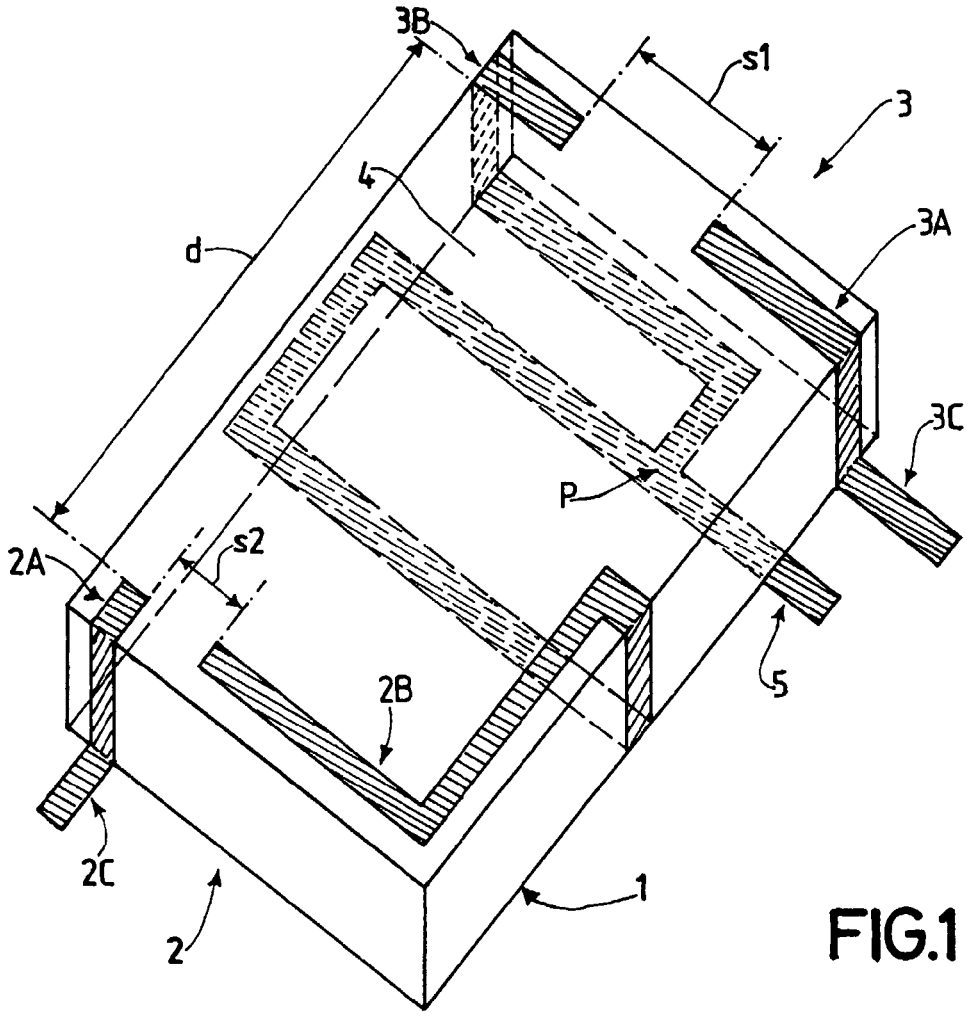
FIG. 1 shows a diagrammatic representation of an antenna according to the invention with two pairs of resonance structures with a single connection to ground.

FIG. 1 shows a first embodiment of an antenna according to the invention having a ceramic substrate 1 made of an NP0 material with a dielectric constant $\in_r$ of 20.6. The substrate has the shape of a right parallelepiped with a volume of $17\times11\times2$ mm$^3$.

Substrate 1 has two pairs of metallic resonator structures 2, 3 on its surface 4. Each of the metallic resonator structures 2, 3 consists of a layer of silver on the substrate. The two pairs of metallic resonator structures 2, 3 have been attached onto the substrate 1 by a printing process. But also other processes can be applied, e.g., a sputtering process or an electro-chemical process and further known processes.

The antenna can be aligned either parallel or vertical to the printed circuit board (not shown) of the telecommunication device. In the latter case a straight line normal to surface 4 is parallel to the printed circuit board.

The first pair of resonator structures 2 comprises a first resonator structure 2A connected to a 50Ω feed line 2C. This first resonator structure 2A, also named feeding resonator, has a corresponding second resonator structure 2B being connected to ground 5. The second pair of resonator structures 3 comprises a first resonator structure 3A connected to a 50Ω feed line 3C. This second resonator structure 2B, also named feeding resonator, has a corresponding second resonator structure 3B being connected to ground 5.

The second resonator structures 2B and 3B have a single connection to ground 5, characterized in a branching of these two structures at branching point P. The length of the second resonance structures 2B and 3B are measured from the branching point P to the corresponding open end. The lengths are such that a resonance frequency of roughly 900 MHz is stimulated in second resonator structure 2B, and thus in the GSM 900 frequency band. A resonance frequency of roughly 1800 MHz (DCS) is stimulated in second resonator structure 3B, and thus in the DCS frequency band.

The feed lines 2C and 3C are chosen to have an impedance of 50Ω each. To match the impedance to the desired value the distance s1 between the open end of the first resonator structure 3A and the open end of the corresponding second resonator structure 3B can be varied accordingly. A smaller distance of s1 leads to a smaller impedance of the corresponding feed line 3C. Accordingly, a smaller distance of s2 leads to a smaller impedance of feed line 2C. With this well-matched impedance the feed lines 2C and 3C can be directly connected to the circuitry of the telecommunication device.

Figure 2:
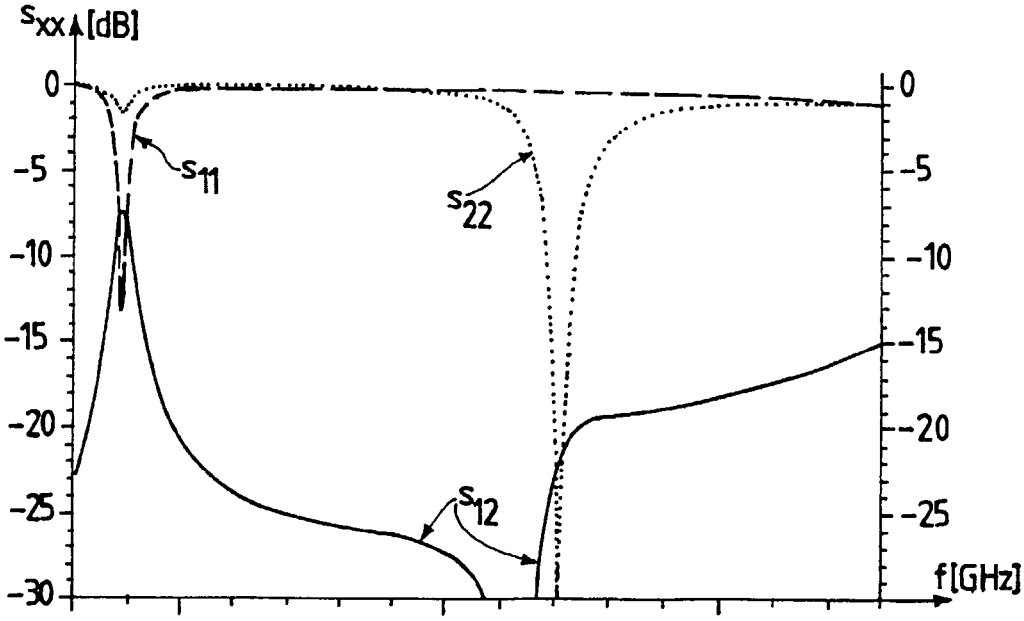
FIG. 2 shows a plot of the scattering parameters $s_{xx}$ of the antenna shown in FIG. 1.

FIG. 2 shows a plot of the scattering parameters $s_{xx}$ of the antenna of FIG. 1 as a function of frequency f. In this diagram the dashed curve s11 represents the scattering parameter of the first pair of resonance structures 2 operating in the GSM frequency range. The dotted curve s22 represents the scattering parameter of the second pair of resonance structures 3 operating in the DCS frequency range. The solid curve s12 (=s21) represents the transmission from one pair of the resonance structures 2, 3 to another pair of the resonance structures 2, 3 and vice versa.

If the telecommunication device being provided for operating in the GSM frequency range, the GSM port will be tuned to be well matched to the 50Ω feed line. In this case the curve s11 has a pronounced resonance dip of −13 dB at around 900 MHz, and thus in the GSM 900 frequency band. At the same time the DCS port is ill matched, as the curve s22 shows only −1,5 dB.

If, on the other hand, the device being provided for operating in the DCS frequency range, the DCS port will be tuned to be well matched to the 50Ω feed line. In this case the curve s22 has a very deep resonance dip of −30 dB at around 1710 MHz, and thus in the DCS 1800 frequency band. At the same time the GSM port is extremely ill matched, as the curve s11 shows no resonator dip in the DCS frequency range.

Scattering parameter s12=s21 represents the transmission from the first to the second port or vice versa. The isolation between the two ports is better than −7,5 dB in the GSM frequency range, and in the DCS frequency range even better (−22 dB).

The total efficiency of the antenna depends on losses due to imperfect matching, and losses caused by the antenna itself. If both types of losses are taken into account the total efficiency is 40% in the GSM frequency range, and 72% in the DCS frequency range. If the losses due to imperfect matching (reflection of signals) are taken into account, the total efficiency is 51.2% in the GSM frequency range, and 72% in the DCS frequency range. The transmission being reduced by choosing a larger distance d between the open ends of the first resonator structures 2A and 3A.

Figure 3:
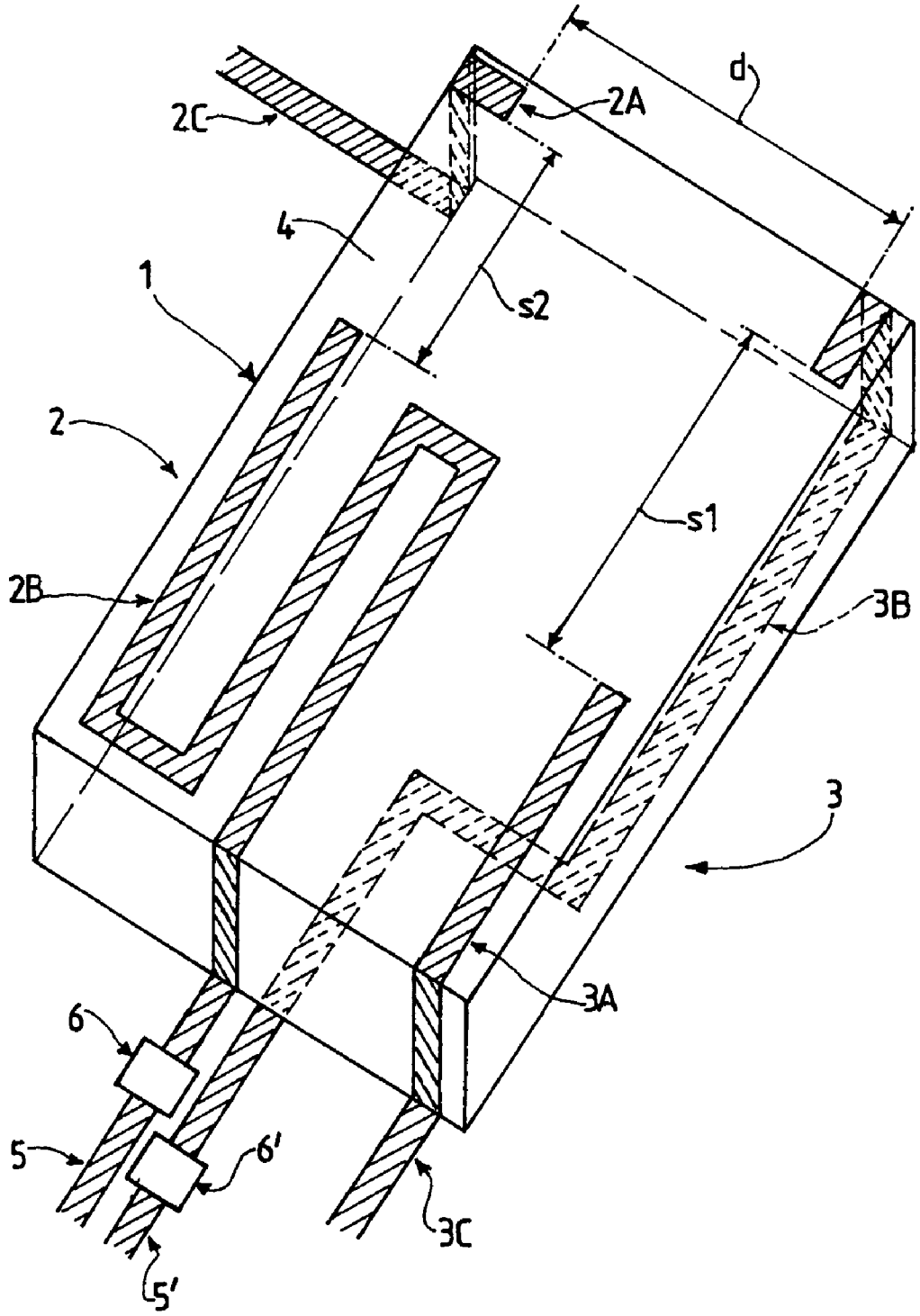
FIG. 3 shows a diagrammatic representation of an antenna according to the invention with two pairs of resonance structures and two connections to ground.

FIG. 3 shows a second embodiment of the antenna according to the invention which embodiment is highly similar to the first embodiment. The geometric shape of the fist resonator structure 2B is now slightly different. More important, the second resonator structures 2B and 3B have separate connections 5 and 5' to ground. This makes it possible to tune the resonance frequency and/or to widen the bandwidth of the two pairs of resonance structures individually by connecting one or more passive components 6, 6' to the second resonator structures 2B, 3B.

It may be mentioned that the features according to the invention may not only be used in hand-held communication devices as mobile phones but also in so-called transponders in the field of radio frequency identification (RFID).

An antenna according to the invention comprising a dielectric substrate may not only be provided with two pairs of metallic resonator structures but may be provided also with three or four or more pairs of metallic resonator structures on its surface.

The invention claimed is:

1. An antenna for wireless communication devices, comprising a dielectric substrate with two pairs of metallic resonator structures provided on a surface of said dielectric substrate, each pair of resonator structures comprising a first resonator structure connected to a feed line and a second resonator structure having a connection to ground, each of the first and second resonator structures comprising an open end, the first and the second resonator structures being electrically isolated from each other and being arranged adjacent to each other, wherein the open ends of the first and second resonator structures of each pair of resonator structures are arranged adjacent to each other.

2. The antenna according to claim 1, characterized in that the first and second resonator structures are elongated structures.

3. The antenna according to claim 2, characterized in that the length of the second resonator structures measured from the point of branching is different.

4. The antenna according to claim 2, wherein the first and second elongated structures have a substantially consistent width along the length of the first and second elongated structures.

5. The antenna according to claim 1, characterized in that the antenna has a single connection to the ground which branches into the second resonator structures.

6. The antenna according to claim 1, characterized in that at least one of the first or second resonator structures is connected to one or more passive components.

7. The antenna according to claim 1, characterized in that the first pair of resonator structures has a resonance frequency substantially in a frequency range of 824 MHz to 960 MHz.

8. The antenna according to claim 1, characterized in that the second pair of resonator structures has a resonance frequency substantially in a frequency range of 1710 MHz to 1990 MHz.

9. A mobile communication device, characterized in that the mobile communication device comprises an antenna according to claim 1.

10. The mobile communication device according to claim 9, wherein the first and second elongated structures have a substantially consistent width along the length of the first and second elongated structures.

11. The mobile communications device according to claim 9, wherein each of the first resonator elements are independently connected to independent feed lines to filter received signals into separate paths corresponding to different frequency bands.

12. The antenna according to claim 1, wherein each of the first resonator elements are independently connected to independent feed lines to filter received signals into separate paths corresponding to different frequency bands.

13. A mobile communication device, comprising:

a transponder for radio frequency identification (RFID) communications; and an antenna comprising a dielectric substrate with two pairs of metallic resonator structures provided on a surface of said dielectric substrate, wherein each pair of resonator structures comprises:

a first resonator structure connected to a feed line and having an open end; and a second resonator structure connected to ground and having an open end;

wherein the first and the second resonator structures being electrically isolated from each other and being arranged adjacent to each other, wherein the open ends of the first and second resonator structures of each pair of resonator structures are arranged adjacent to each other.

14. The mobile communication device according to claim 13, wherein the first and second elongated structures have a substantially consistent width along the length of the first and second elongated structures.

15. The mobile communications device according to claim 13, wherein each of the first resonator elements are independently connected to independent feed lines to filter received signals into separate paths corresponding to different frequency bands.

* * * * *